US011659932B2

(12) United States Patent
Frankel et al.

(10) Patent No.: US 11,659,932 B2
(45) Date of Patent: May 30, 2023

(54) FOLDING SWING CHAIR SUPPORT AND SWING CHAIR

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 17/477,816

(22) Filed: Sep. 17, 2021

(65) Prior Publication Data

US 2023/0092646 A1 Mar. 23, 2023

(51) Int. Cl.
*A47C 4/30* (2006.01)
*A47C 4/28* (2006.01)

(52) U.S. Cl.
CPC ..... *A47C 4/30* (2013.01); *A47C 4/286* (2013.01)

(58) Field of Classification Search
CPC ..... A47C 4/30; A47C 4/286
USPC ..... 297/16.1, 16.2
See application file for complete search history.

(56) References Cited

U.S. PATENT DOCUMENTS 3,124,387 A * 3/1964 Maclaren ..... 297/16.2
3,838,883 A * 10/1974 Machen ..... A47C 4/286 297/16.2
7,328,940 B2 * 2/2008 Zheng ..... 297/16.2
7,681,267 B1 * 3/2010 Hall ..... A47D 5/006 5/115

* cited by examiner

*Primary Examiner* — Anthony D Barfield
(74) *Attorney, Agent, or Firm* — Merek, Blackmon & Voorhees, LLC

(57) ABSTRACT

A folding swing chair support, which comprises: two long rod sets formed by cross-hinging two long rods and two short rod sets formed by cross-hinging two short rods. The two long rod sets stand on the front and rear facades, respectively, and the two sides are hinged by short rod sets to form an associated support as a whole; the upper ends of the two long rods in the long rod sets form suspension points, and the lower ends thereof function to support on the ground. The utility model is characterized by ingenious conception, stable structure, folding and unfolding linkage, and smooth operation.

6 Claims, 3 Drawing Sheets

FOLDING SWING CHAIR SUPPORT AND SWING CHAIR

BACKGROUND OF THE INVENTION

Field of the Invention

The present invention pertains to the field of folding chairs, and particularly relates to a type of folding swing chair and swing chair, which preferably functions to realize self-positioning after unfolding.

Technical Background

The swing chair has a suspension structure and is characterized designing the chair to swing around the suspension pivots under the forces from the weight of the chair user and from the body movement of the chair user. Usually, the usage in most cases is that the swing chair is suspended on a fixed object. There are also some manufacturers who have developed folding swing chairs, which are convenient to be moved to any occasion for use, for example:

Chinese Application CN201820908802.6 shows a type of folding swing chair. A hanging seat is detachably hung on a support. Two sets of stand tubes are connected by intersecting tubes. The distance between the stand tubes can be changed by means of the scissor-like opening and closing of the intersecting tubes, and the intersecting tubes are fixed to the stand tubes by sliders to keep the structure stable and achieve a supporting effect; each slider is hinged onto a support tube, and bottom ends of the support tubes can be in contact with the ground. Stabilization tubes are hinged on the support tubes, and the support tubes are restricted by the stabilization tubes from swinging with respect to the sliders. That is, the positions of the stabilization tubes are fixed; the bottom ends of the stand tubes and the bottom ends of the support tubes can be in contact with the ground, to form a plurality of support points, so that the stand tubes are stably hung in place. Too many hinge points lead to instability. For this reason, a position stopper is also arranged on each sliding slider for fixation purpose.

Another example is Chinese Application CN202022016005.7. On the basis of the above design, a foldable connecting rod is added to connect the supporting structure on the left and right sides. Such supports are all characterized by suspending a flexible chair with a single support rod, which has good shaking and swinging performance. However, a suspension chair of this type is easy to tip over if it is too flexible. A goal of this new utility model is therefore to improve the support structure.

SUMMARY OF THE INVENTION

An aim of the present invention is to provide a folding swing chair support whose front and rear facades are supported by two cross-hinged long rod sets, and the upper ends of the long rods form suspension points, as well as a swing chair made by suspending a flexible hanging seat on this support.

Features of the invention is achieved include:

A type of folding swing chair support comprises two long rod sets formed by cross-hinging two long rods and two short rod sets formed by cross-hinging two short rods. The two to long rod sets stand on the front and rear facades, and the two sides are hinged by short rod sets to form an associated support as a whole. The upper ends of the two long rods in the long rod sets form suspension points, and the lower ends thereof function to support on the ground.

The intersection point of the two short rods in the short rod sets is above the center point of each short rod. After unfolding, the upper ends of the two long rod sets are pulled inward, and the upper and lower ends of the two long rod sets form an isosceles trapezoid from a side view perspective.

Each long rod has an inwardly bending section above a hinge point on a short rod, which functions to shorten the distance between the upper ends of the two long rods in the same set.

A supporting plastic component is also hinged at the cross-hinge point of the two short rods in the short rod sets.

The upper end of each long rod is riveted with a woven strap fastener, and each woven strap fastener has an opening slit for the woven strap to cut in at the transverse direction, and the depth of the opening slit is equivalent to the width of the woven strap.

Each woven strap fastener is also arranged with a blind tube for inserting a thin rod, and each blind tube is inclined upward.

A type of swing chair, which comprises a hanging seat and the aforesaid folding swing chair support. The hanging seat has a seat cushion area and a backrest area, which are characterized in that: the front and rear of the seat cushion area are supported by a front woven strap and a rear woven strap, respectively. Both ends of the front woven strap are correspondingly hung on the woven strap fasteners located at the upper ends of the two long rods on the front facade, and both ends of the rear woven strap are correspondingly hung on the woven strap fasteners located at the upper ends of the two long rods on the rear façade. The backrest area is supported by a backrest woven strap, and both ends of the backrest strap are correspondingly hung on the woven strap fasteners at the upper ends of the two long rods on the rear facade or sewn to the rear woven straps.

The two sides of the seat cushion area are respectively arranged with linings capable of supporting the shape of seat cushion, and the linings have an alternative structure as follows: 1. Rods, which are inserted into the rod sleeves sewn on both sides of the seat cushion area; and 2. Thickened fabrics: Multiple layers of fabrics of the same material as the seat cushion are sewn at both sides of the seat cushion area, or the cushion area is filled with sponge.

The two sides of the seat cushion area are also connected with side wrapping areas, and the rear part of each side wrapping area are sewn to the backrest area to form a three-sided enclosed structure of the seat cushion area.

The front woven strap is stitched around the front edge of the seat cushion area and the front edge of the side wrapping area. The rear woven strap is stitched around the rear edge of the seat cushion area. The backrest strap is divided into two sections: one end is stitched on one side of the backrest area located at the junction of the backrest area and the side wrapping area, while the other end is stitched on the rear woven strap on the same side or suspended on the woven strap fastener at the upper end of the long rod on the same side of the rear facade.

The present invention is characterized by ingenious conception, stable structure, folding and unfolding linkage, and smooth operation. In particular, the front and rear facades are composed of two cross-hinged long rods, forming four-point ground support at the lower end and four suspension points at the upper end. The same side has two upper-end suspension points that are arranged in a narrow manner, which is not only conducive to the shaping of the seat cushion area, but also improves the defect that the swing of existing single pivot design is too flexible.

BRIEF DESCRIPTION OF THE DRAWINGS

Similar reference characters denote corresponding features consistently throughout the attached drawings. Namely, in the drawings the following reference numbers refer to the following part.

| | |
|---|---|
| 1 - Long rod set | 5 - Hanging seat |
| 2 - Long rod | 51 - Seat cushion area |
| 12 - Bending section | 511 - Rod sleeve |
| 2 - Short rod set | 52 - Backrest area |
| 21 - Short rod | 53 - Front woven strap |
| 3 - Supporting plastic component | 54 - Rear woven strap |
| 4 - Woven strap fastener | 55 - Backrest woven strap |
| 41 - Opening slit | 56 - Side wrapping area |
| 42 - Blank tube | |

DETAILED DESCRIPTION OF THE PREFERRED EMBODIMENT(S)

Figure 1:
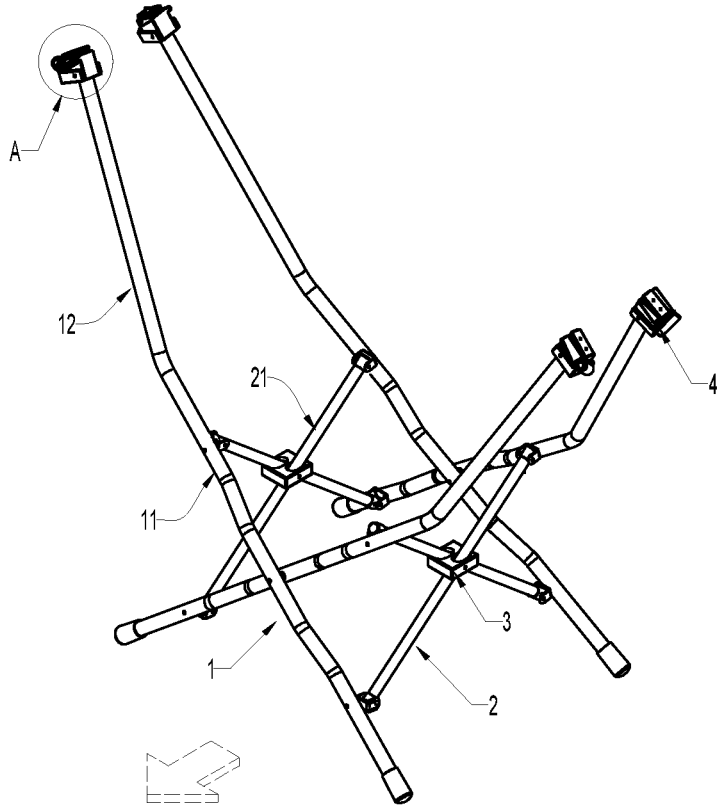
FIG. 1 is an illustration of the folding swing chair support.

With reference now to FIGS. 1 to 6, the folding swing chair support comprises two long rod sets 1 and two short rod sets 2, wherein, the long rod sets 1 are formed by cross-hinging two long rods 11, and the short rod sets 2 are formed by cross-hinging two short rods 21. The two long rod sets 1 stand on the front and rear facades, respectively, and the two sides are hinged by short rod sets 2 to form an associated support as a whole, which makes the folding and unfolding operations smoother. The upper ends of the long rods 11 in the long rod sets form suspension points, and the lower ends thereof function to support on the ground, forming a stable four-foot support structure. The dotted arrow in FIG. 1 represents the front facade direction.

Figure 5:
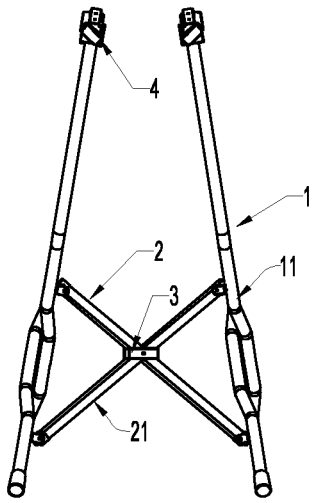
FIG. 5 is a side view of the folding swing chair support.
Figure 6:
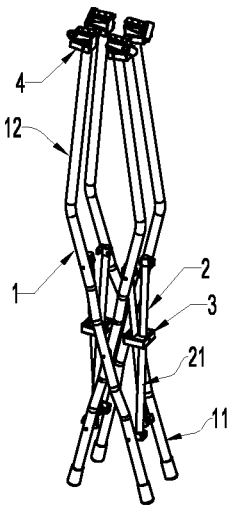
FIG. 6 is an illustration of the folded state of the folding swing chair support.

Furthermore, the intersection point of the two short rods 21 in the short rod sets is above the center point of each short rod. After unfolding, the upper ends of the two long rod sets 1 are pulled inward; and the upper and lower ends of the two long rod sets 11 form an isosceles trapezoid from a side view or side projection perspective, as shown in FIG. 5. That is to say, the upper ends of the long rods 11 of the front and rear sets are narrowed from the side view, and are centered between the two lower ends, forming a splayed stable support structure, which bears the drift of gravity center when swinging back and forth.

Figure 4:
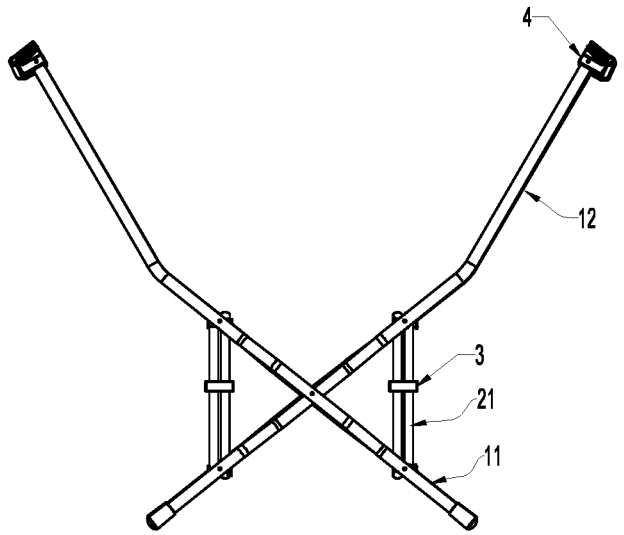
FIG. 4 is a front view of the folding swing chair support.

Each long rod 11 has an inwardly bending section 12 arranged above a point of hinge with each short rod 21, which functions to shorten the distance between the two upper ends of the two long rods 11 in the same set, as shown in FIG. 4. This design also aims to reduce the need for an excessively wide space during unfolding. And more importantly, this increases the height of the upper ends from the ground, thereby increasing the swing radius of the swing chair.

In addition, in each short rod set, a supporting plastic component 3 is also hinged at the cross-hinge point of the two short rods 21, which not only plays the role of limiting the unfolding of the two short rods 21, but also reduces the force borne by the rivet at the hinge point.

Figure 2:
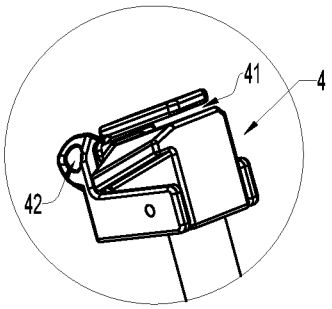
FIG. 2 shows an enlarged image of selection A from FIG. 1.
Figure 3:
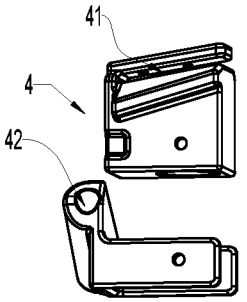
FIG. 3 shows a detailed illustration of the woven strap fasteners.

As shown in FIGS. 1, 2 and 3, the upper end of each long rod 11 is riveted with a woven strap fastener 4, and the woven strap fastener 4 has an opening slit 41 for the woven strap to cut in at the transverse direction, and the depth of the opening slit 41 is equivalent to the width of the woven strap. Each woven strap fastener 4 is also arranged with a blind tube 42 for inserting thin rod. The blind tube 42 can be integrally arranged with the woven strap fastener, or it can also serve as a separate element. The illustration shows a separate structure, which can be used as an optional accessory. The blind tube 42 is inclined upwards. If the blind tube 42 on the front facade is inclined forward and upwards, and the blind tube on the rear facade is inclined backwards and upwards, four thin rods can be inserted into the four blind tubes, so as to support an awning. The blind tubes 42 inclined forward and backwards make the supported awning area larger.

Figure 7:
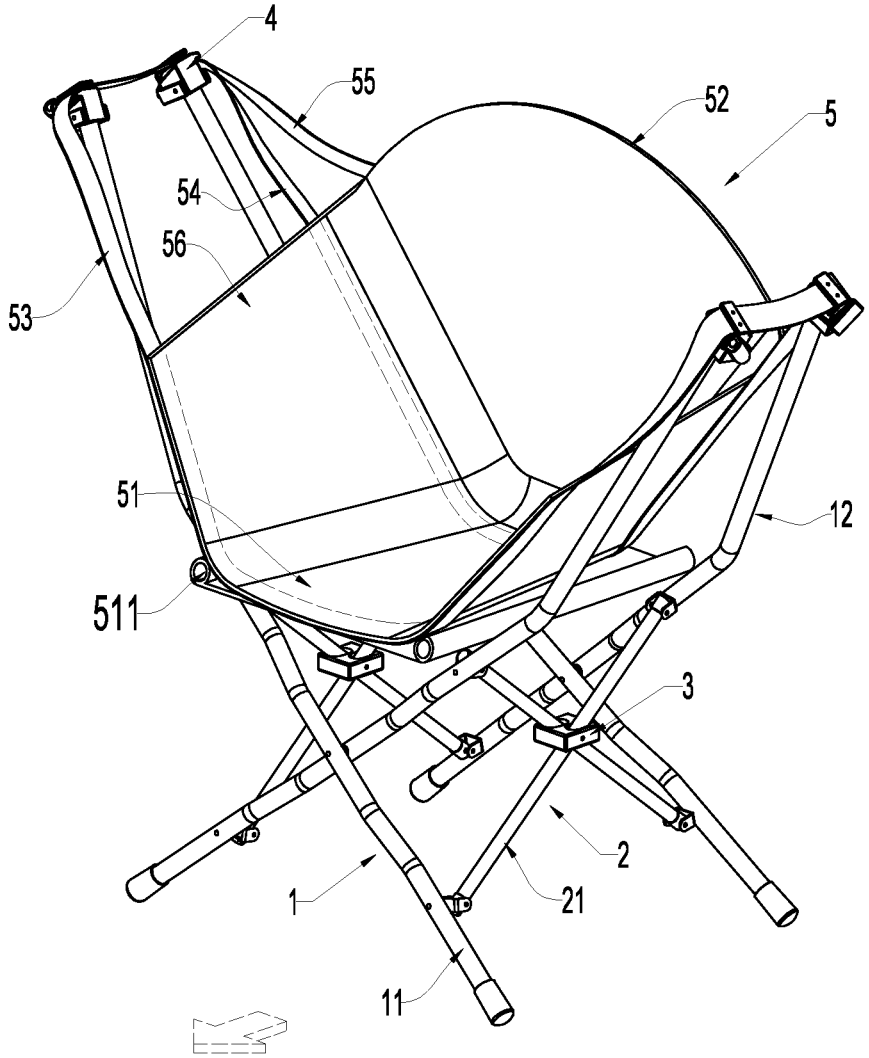
FIG. 7 is an illustration of the folding swing chair.

With reference to FIG. 7, a type of swing chair comprises a hanging seat 5 and the aforesaid folding swing chair support. The hanging seat 5 has a seat cushion area 51 and a backrest area 52. The front and rear of the seat cushion area 51 are supported by a front woven strap 53 and a rear woven strap 54, respectively. Both ends of the front woven strap 52 are correspondingly hung on the woven strap fasteners 4 located at the upper ends of the two long rods 11 on the front facade, and both ends of the rear woven strap 54 are correspondingly hung on the woven strap fasteners 4 located at the upper ends of the two long rods on the rear facade; in this way, a four-point suspension is formed for the seat cushion area 51, hence improving the stability during swinging. On this basis, the front woven strap 53 and the rear woven strap 54 also form a connection between the front and rear woven strap fasteners 4 and are associated with the upper ends of the two long rods 11 in the long rod sets 1 of the front and rear facades, which functions to: i. strengthen the connection of the upper ends of the front and rear long rod sets, in order to avoid a loose structure; ii. distribute the gravity of the suspension structure to the two long rod sets 1, so as to realize stable support; and iii. increase the anti-gravity capacity through the connection of the woven strap fasteners 4 of the front and rear sets to prevent the support from unfold in an excessive width after bearing load. The dotted arrow in FIG. 7 represents the front facade direction.

The backrest area 52 is supported by a backrest woven strap 55. Both ends of the backrest woven strap 55 are respectively hung on the woven strap fasteners 4 located at the upper ends of the two long rods 11 on the rear facade or sewn to the rear woven strap 54. It forms an auxiliary support for the backrest to avoid the user's body tilting backwards when swinging forward.

The two sides of the seat cushion area 51 are respectively provided with linings capable of supporting the shape of seat cushion, and the linings shall preferably be of one of the following two optional structures:

1. The rods are inserted into the rod sleeves 511 sewn on both sides of the seat cushion area 51. The rods have a better shaped appearance, avoiding the situation where the seat cushion area 51 made of flexible fabrics is folded back and forth, and it needs to be unfolded manually when seated. This structure can also improve the appearance of the swing chair.

2. Thicken fabrics: multiple layers of fabrics of the same material as the seat cushion are sewn on both sides of the seat cushion area 51 or can be filled with sponge. Multi-layer thickening treatment can also overcome the shortcomings of the flexible seat cushion area 51 being brought together back and forth.

Furthermore, the two sides of the seat cushion area 51 are also connected with side wrapping areas 56, and the rear part of each side wrapping area 56 are sewn to the backrest area 52 to form a three-sided enclosed structure of the seat cushion area 51. This structural design wraps the user's buttocks better and also improves the user's safety. The upwardly extending side wrapping area 56 can also be used as armrest; for this purpose, the upper edge of the side wrapping areas 56 can also be thickened or are provided with additional linings.

In addition, the front woven strap 53 is stitched around the front edge of the seat cushion area 51 and the front edge of the side wrapping area 56; and the rear woven strap 54 is stitched around the rear edge of the seat cushion area 51, which forms a reinforcement effect on the seat cushion area and improves the load-bearing capacity. The backrest strap 55 is divided into two sections: one end is stitched on one side of the backrest area located at the junction of the backrest area 52 and the side wrapping area 56, while the other end is stitched on the rear woven strap 54 on the same side or suspended on the woven strap fastener 4 at the upper end of the long rod on the same side of the rear facade.

The swing chair is similar in some says to ordinary folding chairs in appearance, but it can provide for a proper forward and backward swing, provides a better use experience, increases the fun of leisure, and can also alleviate the defect of easy fatigue resulting from a single seating posture.

We claim:

1. A folding swing chair support comprising:

two long rod sets formed by cross-hinging two long rods and two short rod sets formed by cross-hinging two short rods;

the two long rod sets stand on the front and rear facades, and the two sides are hinged by short rod sets to form an associated support as a whole;

the upper ends of the two long rods in the long rod sets form suspension points, and the lower ends thereof function to support on the ground the intersection point of the two short rods in the short rod sets is above the center point of each short rod;

and wherein after unfolding, the upper ends of the two long rod sets are pulled inward, and the upper and lower ends of the two long rod sets form an isosceles trapezoid from a side view perspective wherein each long rod has an inward bending section above a hinge point on a short rod, which functions to shorten the distance between the upper ends of the two long rods in the same set;

wherein the upper end of each long rod is riveted with a woven strap fastener, and the woven strap fastener has an opening slit for a woven strap to cut in at the transverse direction, and the depth of the opening slit is equivalent to the width of the woven strap; and wherein each woven strap fastener is also arranged with a blind tube for inserting a thin rod, and each blind tube is inclined upwardly.

2. The folding swing chair support of claim 1, wherein a supporting plastic component is also hinged at the cross hinge point of the two short rods in the short rod sets.

3. A folding swing chair support comprising:

two long rod sets formed by cross-hinging two long rods and two short rod sets formed by cross-hinging two short rods;

the two long rod sets stand on the front and rear facades, and the two sides are hinged by short rod sets to form an associated support as a whole;

the upper ends of the two long rods in the long rod sets form suspension points, and the lower ends thereof function to support on the ground a front and rear of the seat cushion area are supported by a front woven strap and a rear woven strap, respectively; both ends of the front woven strap are correspondingly hung on the woven strap fasteners located at upper ends of the two long rods on the front facade, and both ends of the rear woven strap are correspondingly hung on woven strap fasteners located at the upper ends of the two long rods on the rear facade; and a backrest area is supported by a backrest woven strap, and both ends of the backrest strap are correspondingly hung on the woven strap fasteners at the upper ends of the two long rods on the rear facade or sewn to the rear woven straps.

4. The folding swing chair support of claim 3, wherein:

two sides of the seat cushion area include linings capable of supporting the shape of seat cushion, and the linings have an alternative structure as follows: (a) rods, which are inserted into the rod sleeves sewn on both sides of the seat cushion area; and (b) thickened fabrics, wherein multiple layers of fabrics of the same material as the seat cushion are sewn at both sides of the seat cushion area, or the cushion area is filled with sponge.

5. The folding swing chair support of claim 3, wherein the two sides of the seat cushion area are also connected with side wrapping areas, and the rear part of each side wrapping area are sewn to the backrest area, so as to form a three-sided enclosed structure of the seat cushion area.

6. The folding swing chair support of claim 5, wherein:

the front woven strap is stitched around the front edge of the seat cushion area and the front edge of the side wrapping area;

the rear woven strap is stitched around the rear edge of the seat cushion area;

the backrest strap is divided into two sections: one end is stitched on one side of the backrest area located at the junction of the backrest area and the side wrapping area, while the other end is stitched on the rear woven strap on the same side or suspended on the woven strap fastener at the upper end of the long rod on the same side of the rear facade.

* * * * *